US012291952B2

(12) United States Patent
Al-Taq et al.

(10) Patent No.: US 12,291,952 B2
(45) Date of Patent: May 6, 2025

(54) IN-RESERVOIR CLEANUP OPERATIONS THROUGH EXOTHERMIC REACTION FOLLOWING A FRACTURING OPERATION

(71) Applicants: SAUDI ARABIAN OIL COMPANY, Dhahran (SA); KING FAHD UNIVERSITY OF PETROLEUM & MINERALS, Dhahran (SA)

(72) Inventors: Ali Abdullah Al-Taq, Dhahran (SA); Sajjad A. Aldarweesh, Dhahran (SA); Murtada S. Al-Jawad, Dhahran (SA)

(73) Assignees: SAUDI ARABIA, Dhahran (SA); KING FAHD UNIVERSITY OF PETROLEUM & MINERALSN OIL COMPANY, Dhahran (SA)

( * ) Notice: Subject to any disclaimer, the term of this patent is extended or adjusted under 35 U.S.C. 154(b) by 0 days.

(21) Appl. No.: 18/471,985

(22) Filed: Sep. 21, 2023

(65) Prior Publication Data

US 2025/0101841 A1 Mar. 27, 2025

(51) Int. Cl.
*E21B 43/26* (2006.01)
*E21B 36/00* (2006.01)

(52) U.S. Cl.
CPC ..... *E21B 43/26* (2013.01); *E21B 36/008* (2013.01)

(58) Field of Classification Search
CPC ..... E21B 43/26; E21B 36/008
See application file for complete search history.

(56) References Cited

U.S. PATENT DOCUMENTS

| | | | | |
|---|---|---|---|---|
| 9,976,073 | B2 | 5/2018 | Salla et al. | |
| 10,422,206 | B2 | 9/2019 | Karale et al. | |
| 2017/0130568 | A1* | 5/2017 | Al-Nakhli | E21B 47/07 |
| 2018/0320054 | A1* | 11/2018 | Al-Nakhli | C09K 8/532 |
| 2019/0185738 | A1* | 6/2019 | Al-Nakhli | E21B 36/008 |
| 2021/0024815 | A1* | 1/2021 | Al-Taq | C09K 8/80 |
| 2021/0363866 | A1* | 11/2021 | Al-Nakhli | C09K 8/665 |

FOREIGN PATENT DOCUMENTS

| | | | |
|---|---|---|---|
| CN | 101323780 | B | 6/2010 |
| CN | 104790933 | A | 7/2015 |
| CN | 110272726 | A | 9/2019 |
| CN | 111100624 | A | 5/2020 |
| CN | 111944511 | A | 11/2020 |
| CN | 114085662 | A | 2/2022 |
| WO | 2014149524 | A1 | 9/2014 |

OTHER PUBLICATIONS

Nguyen, D.A., Iwaniw,M.A., Fogler, H.S.: "Kinetics and mechanism of the reaction between ammonium and nitrite ions: experimental and theoretical studies," Chemical Engineering Science 58 (2003) 4351-4362.

Bispo, Felipe J. S., Kartnaller, Vinicius, and João Cajaiba. "pH-Based Control of the Kinetics and Process Safety of the Highly Exothermic Reaction Between Ammonium Chloride and Sodium Nitrite for Flow-Assurance Applications." SPE J. 26 (2021): 3634-3642.

* cited by examiner

*Primary Examiner* — Silvana C Runyan
(74) *Attorney, Agent, or Firm* — Vorys, Sater, Seymour and Pease LLP

(57) ABSTRACT

Methods of cleanup for hydraulic fracturing operations using a polymeric thickening agent may include use of exothermically reactive salts. For example, a method of cleanup may include use of a first fluid including a first exothermically reactive salt and a second fluid including a second exothermically reactive salt. Upon introduction into a subterranean reservoir, exothermically reactive salts may undergo an exothermic reaction to generate heat, and such heat generated from the exothermic reaction may break a polymeric thickening agent and decrease viscosity thereof.

20 Claims, 3 Drawing Sheets

IN-RESERVOIR CLEANUP OPERATIONS THROUGH EXOTHERMIC REACTION FOLLOWING A FRACTURING OPERATION

FIELD OF THE DISCLOSURE

The present disclosure relates generally to hydraulic fracturing and, more particularly, to cleanup operations following a fracturing operation.

BACKGROUND OF THE DISCLOSURE

Fracturing operations may be performed within a subterranean formation (subterranean reservoir) to achieve, increase, or restore hydrocarbon production therefrom, such as oil and gas. Oftentimes, fracturing operations may be employed in subterranean reservoirs where conventional techniques have yielded limited production, such as in shale formations and other tight reservoirs, for example. During a fracturing operation, a fluid (fracturing fluid) is introduced into a subterranean formation under high hydraulic pressures to expand and/or generate fluid conduits within the formation matrix to increase fluid conductivity by forcing the formation matrix apart. The term "fracture" is used herein in reference to these types of fluid conduits. The manner in which fracturing operations are conducted under particular circumstances may depend on factors including, for example, the geology of the formation and the type of hydrocarbons being produced.

Fracturing fluids commonly employ a polymeric thickening agent (viscosifying agent) to facilitate transport of proppant particulates that may aid in maintaining the generated fractures in an open condition following release of the hydraulic pressure. Unfortunately, the polymeric thickening agent can leave a residue in the subterranean reservoir that may inhibit hydrocarbon production. As such, the polymeric thickening agent may commonly be removed or de-viscosified during a cleanup operation to facilitate the subsequent production of hydrocarbons. The term "cleanup" refers to the removal of extraneous material (e.g., polymeric thickening agent) from a subterranean reservoir to improve production of hydrocarbons therefrom. Cleanup fluids commonly incorporate breaker fluid chemicals, such as various surfactants and oxidants, to facilitate removal of the polymeric thickening agent. The additional cleanup operation step and associated breaker fluid chemicals may represent a significant added expense associated with conducting a fracturing operation and achieving subsequent hydrocarbon production.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

In some embodiments, methods of the present disclosure comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; and contacting the first fluid with the second fluid in the subterranean reservoir during a cleanup period under conditions at which the first salt and the second salt undergo the exothermic reaction to generate heat; wherein the heat generated from the exothermic reaction at least partially breaks the polymeric thickening agent and decreases the first viscosity to a second viscosity.

In some or other embodiments, methods of the present disclosure comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein the subterranean reservoir has a temperature sufficient to initiate the exothermic reaction between the first salt and the second salt; and contacting the first fluid with the second fluid in the subterranean reservoir during a cleanup period in which the first salt and the second salt undergo the exothermic reaction to generate heat; wherein the heat generated from the exothermic reaction at least partially breaks the polymeric thickening agent and decreases the first viscosity to a second viscosity.

In still other embodiments, methods of the present disclosure comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein at least one of the first fluid or the second fluid contains an acid that initiates the exothermic reaction between the first salt and the second salt; and contacting the first fluid with the second fluid in the subterranean reservoir during a cleanup period in which the first salt and the second salt undergo the exothermic reaction to generate heat; wherein the heat generated from the exothermic reaction at least partially breaks the polymeric thickening agent and decreases the first viscosity to a second viscosity.

In yet still other embodiments, methods of the present disclosure comprise: providing a first fluid having a first viscosity, the first fluid comprising a polymeric thickening agent, a first salt, and a second salt, the first salt and the second salt being capable of undergoing an exothermic reaction with each other; introducing the first fluid into a subterranean reservoir at a pressure sufficient to create or extend one or more fractures therein; wherein the subterranean reservoir has a temperature insufficient to initiate the exothermic reaction between the first salt and the second salt; introducing an acid into the subterranean reservoir to initiate the exothermic reaction; and contacting the first fluid and the acid during a cleanup period in which the first salt and the second salt undergo the exothermic reaction to generate heat; wherein the heat generated from the exothermic reaction at least partially breaks the polymeric thickening agent and decreases the first viscosity to a second viscosity.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
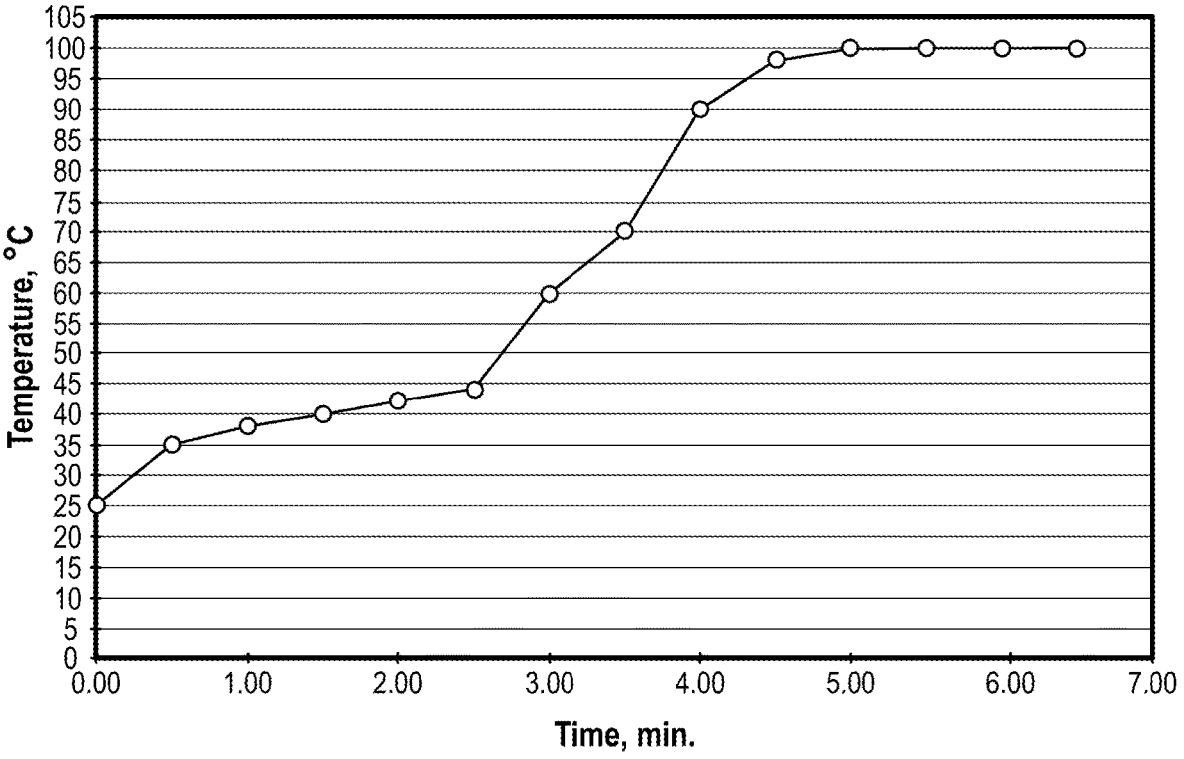
FIG. 1 is an example graph showing the temperature increase occurring during an exothermic reaction of sodium nitrite and ammonium chloride.

Embodiments in accordance with the present disclosure generally relate to hydraulic fracturing and, more particularly, to cleanup operations following a fracturing operation.

Conventional fracturing operations commonly employ a separate cleanup operation following the release of hydraulic pressure, which adds additional treatment steps that may increase the time and expense of conducting a fracturing operation and subsequent hydrocarbon production. The present disclosure facilitates post-fracturing cleanup operations by incorporating a portion of the breaker chemicals in the fracturing fluid itself. In particular, the methods of the present disclosure incorporate into a fracturing fluid a first salt that is capable of undergoing an exothermic reaction with a second salt under specified conditions. The first salt may be contacted with the second salt after the hydraulic pressure is released, thereby initiating the exothermic reaction, and the heat generated from the exothermic reaction may increase the temperature of the surrounding fluid to afford in situ breaking of polymeric thickening agent residue within the subterranean reservoir. Unlike conventional cleanup operations, which may employ surfactants or oxidants, breaking of the polymeric thickening agent may occur through thermal degradation in the disclosure herein. By conducting a cleanup operation in the foregoing manner, the cleanup operation may be less complicated and less costly compared to conventional cleanup operations. The present disclosure may further facilitate cleanup operations under a wider variety of conditions (e.g., pH and/or temperature) as compared to conventional cleanup operations. Viscosity reductions of about 75% or greater, or about 90% or greater, or about 99% or greater may be realized upon heating, which may facilitate removal of the fracturing and cleanup fluids to allow subsequent production of hydrocarbons to commence.

While a first salt may be included in a fracturing fluid in the present disclosure primarily for purposes of promoting an exothermic reaction when exposed to a second salt, additional advantages and synergies may also be realized by doing so. Fracturing fluids frequently may employ aqueous salt solutions or high-density brines as a carrier fluid to convey sufficient weight to the fracturing fluid. The first salt in the fracturing fluid may replace or supplement at least a portion of the salt that might otherwise already be present in the fracturing fluid. In addition, some salts may convey stability to the formation matrix when fracturing a subterranean reservoir containing significant amounts of clay (i.e., a clay-containing subterranean reservoir). Salts containing an ammonium cation may be especially effective in this regard. As discussed hereinafter, ammonium salts may be particularly suitable salts for promoting an exothermic reaction according to the disclosure herein. Although it may be advantageous to utilize an ammonium salt as the first salt in the disclosure herein, it is to be appreciated that the present disclosure is not limited in this respect, and any combination of salt capable of undergoing the exothermic reaction may be utilized as the first and second salts, or vice versa, provided that the salt does not interfere with the fracturing operation or inhibit subsequent hydrocarbon production.

Accordingly, methods of the present disclosure may comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; and contacting the first fluid with the second fluid in the subterranean reservoir during a cleanup period under conditions at which the first salt and the second salt undergo the exothermic reaction to generate heat. The heat generated from the exothermic reaction at least partially breaks the polymeric thickening agent and decreases the first viscosity to a second viscosity.

The first fluid may be introduced to the subterranean reservoir to promote hydraulic fracturing and to deliver the first salt to the subterranean reservoir for performing subsequent cleanup. The second fluid may deliver the second salt to the subterranean reservoir so that the exothermic reaction may occur to then facilitate subsequent hydrocarbon production.

Any hydrocarbon-bearing subterranean reservoir capable of undergoing fracturing may be suitably treated by the methods of the present disclosure. In particular examples, the subterranean reservoir may comprise a clay-containing subterranean reservoir, such as a shale formation. Other suitable subterranean reservoirs may include carbonate reservoirs and sandstone reservoirs, for example.

The first fluid may include one or more first salts that are capable of undergoing an exothermic reaction once contacted with one or more suitable second salts under conditions at which the exothermic reaction may occur. In non-limiting examples, the first and second salts may comprise any combination of an ammonium cation and a nitrite anion. In some examples, the first salt may comprise a nitrite anion and the second salt may comprise an ammonium cation, wherein the nitrite anion and the ammonium cation may undergo the exothermic reaction when exposed to suitable conditions. In other examples, the first salt may comprise an ammonium cation and the second salt may comprise a nitrite anion, wherein the nitrite anion and the ammonium cation may undergo the exothermic reaction when exposed to suitable conditions. In more specific examples, the first and second salts may comprise an ammonium halide, such as ammonium chloride, and an alkali metal nitrite, such as sodium nitrite. Accordingly, in some examples, the first salt may comprise a nitrite anion, such as sodium nitrite or other alkali metal nitrite, and the second salt may comprise an ammonium cation, such as ammonium chloride or other ammonium halide. In other examples, the first salt may comprise an ammonium cation, such as ammonium chloride or other ammonium halide, and the second salt may comprise a nitrite anion, such as sodium nitrite or other alkali metal nitrite. Process configurations in which the first salt comprises an ammonium cation may be particularly advantageous for fracturing a subterranean reservoir comprising a clay, since ammonium salts may aid in promoting clay stabilization.

The term "exothermic" and grammatical variants thereof, as used herein, refer to a chemical reaction that generates thermal energy (e.g., heat) and may be defined as a reaction having an enthalpy of reaction ($\Delta H$) less than zero. The exothermic reaction of sodium nitrite and ammonium chloride is shown in Reaction 1 below:

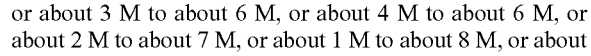

$$NaNO_2+NH_4Cl \rightarrow NaCl+H_2O+N_2 \quad \text{Reaction 1}$$

In the case of the exothermic reaction between sodium nitrite and ammonium chloride, the enthalpy of reaction is $-79.95$ kcal $mol^{-1}$. FIG. 1 is an example graph showing the temperature increase occurring during an exothermic reaction of sodium nitrite and ammonium chloride. The temperature increase resulting from the exothermic reaction may be sufficient to facilitate breaking of the polymeric thickening agent, in accordance with the disclosure herein.

The first fluid and the second fluid each have a salt concentration sufficient to generate an effective amount of heat within the subterranean reservoir to facilitate breaking of the polymeric thickening agent. For example, salt concentrations for the first fluid and the second fluid may independently range from about 1 M (mol/L) to about 10 M, or about 3 M to about 6 M, or about 4 M to about 6 M, or about 2 M to about 7 M, or about 1 M to about 8 M, or about 1 M to about 10 M, or even greater than 10 M. The salt concentration of the first fluid and the second fluid may be the same or may differ. The molar quantities of the first salt and the second salt may likewise be the same or may differ. Similarly, the volume of the first fluid and the second fluid introduced to the subterranean reservoir may be the same or differ. By varying the salt concentration, the amounts of the first and second salts, and amounts of the first and second fluids, the quantity of heat released in the exothermic reaction may be varied based on application-specific needs.

The polymeric thickening agent within the first fluid may be any suitable polymer-based agent that imparts viscosity to the fluid. The polymeric thickening agent may have a concentration within the first fluid from about 1 ppt (parts per thousand) to about 500 ppt, or about 1 ppt to about 400 ppt, or about 10 ppt to about 300 ppt, or about 10 ppt to about 250 ppt, or about 10 ppt to about 100 ppt, or about 20 ppt to about 50 ppt, or about 25 ppt to about 55 ppt. Suitable polymeric thickening agents may include, but are not limited to, polysaccharides, poly((C2-C10)alkenylenes), poly (acrylic acid) or (C1-C5)alkyl esters thereof, poly(methacrylic acid) or (C1-C5)alkyl esters thereof, poly(vinyl acetate), poly(vinyl alcohol), poly(ethylene glycol), poly (vinyl pyrrolidone), polyacrylamide, poly(hydroxyethyl methacrylate), alginate, chitosan, curdlan, dextran, emulsan, gellan, glucuronan, N-acetyl-glucosamine, N-acetyl-heparosan, hyaluronic acid, kefiran, lentinan, levan, mauran, pullulan, scleroglucan, schizophyllan, stewartan, succinoglycan, xanthan, welan, derivatized starch, tamarind, tragacanth, guar gum, derivatized guar (for example, hydroxypropyl guar, carboxy methyl guar, or carboxymethyl hydroxylpropyl guar), gum ghatti, gum arabic, locust bean gum, and derivatized cellulose (for example, carboxymethyl cellulose, hydroxyethyl cellulose, carboxymethyl hydroxyethyl cellulose, hydroxypropyl cellulose, or methyl hydroxyl ethyl cellulose), or any combination thereof.

In some examples, the polymeric thickening agent may comprise a poly(vinyl alcohol) homopolymer, poly(vinyl alcohol) copolymer, a crosslinked poly(vinyl alcohol) homopolymer, or a crosslinked poly(vinyl alcohol) copolymer. The polymeric thickening agent may include a poly (vinyl alcohol) copolymer or a crosslinked poly(vinyl alcohol) copolymer including at least one of a graft, linear, branched, block, or random copolymer of vinyl alcohol and at least one of a substituted or unsubstituted (C2-C50) hydrocarbyl having an olefinic unsaturation. The polymeric thickening agent may include a poly(vinyl alcohol) copolymer or a crosslinked poly(vinyl alcohol) copolymer including at least one of a graft, linear, branched, block, or random copolymer of vinyl alcohol and at least one of vinyl phosphonic acid, vinylidene diphosphonic acid, substituted or unsubstituted 2-acrylamido-2-methylpropanesulfonic acid, a substituted or unsubstituted (C1-C20)alkenoic acid, propenoic acid, butenoic acid, pentenoic acid, hexenoic acid, octenoic acid, nonenoic acid, decenoic acid, acrylic acid, methacrylic acid, hydroxypropyl acrylic acid, acrylamide, fumaric acid, methacrylic acid, hydroxypropyl acrylic acid, vinyl phosphonic acid, vinylidene diphosphonic acid, itaconic acid, crotonic acid, mesoconic acid, citraconic acid, styrene sulfonic acid, allyl sulfonic acid, methallyl sulfonic acid, vinyl sulfonic acid, and a substituted or unsubstituted (C1-C20)alkyl ester thereof. The polymeric thickening agent may include a poly(vinyl alcohol) copolymer or a crosslinked poly(vinyl alcohol) copolymer including at least one of a graft, linear, branched, block, or random copolymer of vinyl alcohol and at least one of vinyl acetate, vinyl propanoate, vinyl butanoate, vinyl pentanoate, vinyl hexanoate, vinyl 2-methyl butanoate, vinyl 3-ethylpentanoate, and vinyl 3-ethylhexanoate, maleic anhydride, a substituted or unsubstituted (C1-C20)alkenoic substituted or unsubstituted (C1-C20)alkanoic anhydride, a substituted or unsubstituted (C1-C20)alkenoic substituted or unsubstituted (C1-C20)alkenoic anhydride, propenoic acid anhydride, butenoic acid anhydride, pentenoic acid anhydride, hexenoic acid anhydride, octenoic acid anhydride, nonenoic acid anhydride, decenoic acid anhydride, acrylic acid anhydride, fumaric acid anhydride, methacrylic acid anhydride, hydroxypropyl acrylic acid anhydride, vinyl phosphonic acid anhydride, vinylidene diphosphonic acid anhydride, itaconic acid anhydride, crotonic acid anhydride, mesoconic acid anhydride, citraconic acid anhydride, styrene sulfonic acid anhydride, allyl sulfonic acid anhydride, methallyl sulfonic acid anhydride, vinyl sulfonic acid anhydride, and an N—(C1-C10)alkenyl nitrogen containing substituted or unsubstituted (C1-C10)heterocycle. The polymeric thickening agent may include a poly (vinyl alcohol) copolymer or a crosslinked poly(vinyl alcohol) copolymer including at least one of a graft, linear, branched, block, and random copolymer that includes a poly(vinylalcohol)-poly(acrylamide) copolymer, a poly(vinylalcohol)-poly(2-acrylamido-2-methylpropanesulfonic acid) copolymer, or a poly(vinylalcohol)-poly(N-vinylpyrrolidone) copolymer. The polymeric thickening agent may include a crosslinked poly(vinyl alcohol) homopolymer or copolymer including a crosslinker including at least one of an aldehyde, an aldehyde-forming compound, a carboxylic acid or an ester thereof, a sulfonic acid or an ester thereof, a phosphonic acid or an ester thereof, an acid anhydride, and an epihalohydrin.

It is to be understood that the foregoing list of polymeric thickening agents is exemplary. Other types of suitable polymeric thickening agents will be recognizable to persons having ordinary skill in the art. Any polymeric thickening agent that may undergo breaking upon exposure to heat generated by the exothermic reaction may be utilized in the disclosure herein.

Optionally, the first fluid may further comprise at least one crosslinking agent effective to crosslink the polymeric thickening agent. Suitable examples of crosslinkers will be familiar to persons having ordinary skill in the art.

Furthermore, the first fluid and/or the second fluid may further include one or more stabilizers and/or one or more surfactants. Suitable stabilizers and/or surfactants may each be included at suitable concentrations to achieve desired functionality or performance. In non-limiting examples, stabilizers and/or surfactants may be included in the first fluid and/or the second fluid in an amount ranging from, for example, about 0.01 wt % to about 20 wt %, or about 0.01 wt % to about 10 wt %, based on the total weight of the fluid. Stabilizers suitable for use in the present disclosure may include, but are not limited to, for example, a gel stabilizer, a clay stabilizer, a thiosulfate stabilizer (e.g., sodium thiosulfate, the like, or any combination thereof), a sorbitol stabilizer (e.g., alkylated sorbitol, the like, or any combination thereof), an alkaline earth metal oxide (calcium oxide, magnesium oxide, the like, or any combination thereof), the like, or any combination thereof. Surfactants suitable for use in the present disclosure may include, but are not limited to, for example, anionic surfactants, cationic surfactants, nonionic surfactants, zwitterionic surfactants, the like, or any combination thereof. Especially for use in conjunction with fracturing operations, nonionic surfactants may be preferred.

The first fluid and the second fluid may each include an aqueous fluid as a carrier fluid for the previously described components. Examples of suitable aqueous fluids may include, but are not limited to, fresh water (e.g., stream water, lake water, or municipal treated water), non-potable water such as gray water or industrial process water, sea water, brine, aqueous salt solutions, partially desalinated water, produced water (including brine and other salt water solutions), the like, or any combination thereof.

Once the first salt and the second salt have been contacted in the subterranean reservoir, a cleanup period may follow to allow sufficient time for the heat released by the exothermic reaction to break the polymeric thickening agent. Examples of cleanup period durations may include, but are not limited to, about 1 hour or greater, or about 6 hours or greater, or about 12 hours or greater, or about 24 hours or greater, or about 48 hours or greater, such as about 1 hour to about 48 hours, or about 1 hour to about 72 hours, or about 6 hours to about 12 hours, or about 8 hours to about 24 hours. The duration of the cleanup period may be affected by factors including, for example, the geology of the subterranean formation, the initial viscosity of the first fluid and/or the second fluid, the concentrations and amounts of the first and second salts, the like, or any combination thereof.

During the cleanup period, the viscosity of the combined fluids within the subterranean reservoir may be reduced by about 50% or more, or about 75% or more, or about 80% or more, or about 90% or more, or about 99% or more, such as about 50% to about 99.9%, or about 70% to about 99.9%, or about 95% to about 99.9%, each as compared to the viscosity of the first fluid being introduced to the subterranean reservoir.

The first fluid may be a fracturing fluid that is introduced to the subterranean reservoir at a pressure sufficient to create or extend one or more fractures therein. The pressure may be reduced (e.g., released) prior to introduction of the second fluid or subsequent fluids. Fluids of the present disclosure may be introduced to the subterranean reservoir via any suitable means.

The first fluid may further comprise a plurality of particulates, which may be referred to as proppants or proppant particulates herein. Such proppants may, without being bound by theory, serve to maintain open fractures within at least a portion of the subterranean reservoir into which the fracturing fluid is introduced. The plurality of particulates may be introduced to the plurality of fractures prior to introducing the second fluid, such that the proppant particulates settle therein. Proppant particulates suitable for use in the disclosure herein are not considered to be especially limited. In non-limiting examples, suitable proppant particulates may comprise sand, a ceramic (inclusive of glass materials, oxide ceramic materials, and/or non-oxide ceramic materials, such as metal oxides, and/or metal or non-metal carbides, borides, nitrides, and/or silicides), bauxite, polymer materials, polytetrafluoroethylene materials, nut shell pieces, cured resinous particulates including nut shell pieces, seed shell pieces, cured resinous particulates including seed shell pieces, fruit pit pieces, cured resinous particulates including fruit pit pieces, wood, composite particulates, and combinations thereof. Suitable composite particulates may include a binder and a filler material wherein suitable filler materials may include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof.

Once within the subterranean reservoir, the first and second salts may undergo the exothermic reaction under specified conditions. The exothermic reaction may occur at a specified temperature, preferably a temperature greater than about 50° C., or greater than about 60° C., or greater than about 70° C., such as within a range from about 50° C. to about 95° C., for example. Preferably, heating of the first and second salts to the temperature sufficient to promote the exothermic reaction may take place using latent heat present within the subterranean reservoir. That is, upon mixing the first fluid and the second fluid within the subterranean reservoir at the latent formation temperature, the exothermic reaction may occur to facilitate a temperature increase to afford a temperature above the latent formation temperature. Alternately, at least one of the first fluid or the second fluid may be heated prior to or concurrently with introduction of the fluid(s) to the subterranean reservoir to promote the exothermic reaction between the first and second salts.

Alternately or additionally, the exothermic reaction may be catalyzed by an acid, such as at a pH of about 5 or less. An acid may be introduced into the subterranean reservoir or be present in one of the first fluid or second fluid to catalyze the reaction. Alternately, an acid-containing fluid may be introduced to the subterranean reservoir separately from the first fluid and the second fluid, preferably after introduction of the second fluid. When the first salt comprises a nitrite anion and the second salt comprises an ammonium cation, the acid may be readily introduced within the second fluid. Nitrite anions may be unstable to acid and form nitrous acid in the presence of a sufficiently strong acid. Hence, nitrite ions may be kept separate from the acid until the acid is needed to catalyze the exothermic reaction according to the disclosure herein. The acid may be an inorganic acid (e.g., hydrochloric acid or hydrobromic acid), an organic acid, or any suitable combination thereof. Preferably, the acid may be an organic acid such as formic acid, acetic acid, propionic acid, methanesulfonic acid, chloroacetic acid, trifluoroacetic acid, the like, or any combination thereof.

Accordingly, in some examples, methods of the present disclosure may be conducted in subterranean formations that have a sufficient temperature to promote the exothermic reaction between the first salt and the second salt, such as a temperature of at least about 50° C. or greater or about 60° C. or greater in the case of a nitrite salt and an ammonium salt. Such methods may comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein the subterranean reservoir has a temperature sufficient to initiate the exothermic reaction between the first salt and the second salt; and contacting the first fluid with the second fluid in the subterranean reservoir during a cleanup period in which the first salt and the second salt undergo the exothermic reaction to generate heat. The heat generated from the exothermic reaction at least partially breaks the polymeric thickening agent and decreases the first viscosity to a second viscosity.

In other instances, the subterranean reservoir may have a temperature insufficient to initiate the exothermic reaction, in which case an acid may be introduced to the subterranean reservoir in at least one of the first fluid or the second fluid to catalyze the exothermic reaction. Alternately, an acid may be introduced to the subterranean reservoir separately from the first fluid and the second fluid. Such methods may comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein at least one of the first fluid or the second fluid contains an acid that initiates the exothermic reaction between the first salt and the second salt; and contacting the first fluid with the second fluid in the subterranean reservoir during a cleanup period in which the first salt and the second salt undergo the exothermic reaction to generate heat. The heat generated from the exothermic reaction at least partially breaks the polymeric thickening agent and decreases the first viscosity to a second viscosity.

In an alternative process configuration, the first and second salts may be present in a single fluid that initiates fracturing, provided that the subterranean formation has a temperature insufficient to initiate the exothermic reaction. In this case, an acid may be delivered to the subterranean reservoir after the first fluid has been introduced thereto to promote the exothermic reaction between the first salt and the second salt. Such methods may comprise: providing a first fluid having a first viscosity, the first fluid comprising a polymeric thickening agent, a first salt, and a second salt, the first salt and the second salt being capable of undergoing an exothermic reaction with each other; introducing the first fluid into a subterranean reservoir at a pressure sufficient to create or extend one or more fractures therein; wherein the subterranean reservoir has a temperature insufficient to initiate the exothermic reaction between the first salt and the second salt; introducing an acid into the subterranean reservoir to initiate the exothermic reaction; and contacting the first fluid and the acid during a cleanup period in which the first salt and the second salt undergo the exothermic reaction to generate heat. The heat generated from the exothermic reaction at least partially breaks the polymeric thickening agent and decreases the first viscosity to a second viscosity.

Alternately, an acid may be introduced to the subterranean reservoir to further promote the exothermic reaction, even when the subterranean reservoir already has a temperature sufficient to initiate the exothermic reaction between the first salt and the second salt.

The methods of the present disclosure may utilize additional fluids and/or include components to carry out a desired fracturing operation. As a nonlimiting example, a pad fluid may be introduced to the subterranean reservoir before introduction of the first fluid. The pad fluid may have a similar composition to that of the first fluid, but may lack proppant particulates and optionally lack the first salt.

Fluids of the present disclosure may further include one or more additional components suitable for achieving one or more desired functions (e.g., in addition to facilitating fracturing or cleanup). Examples of suitable additional components may include, but are not limited to, a salt, a weighting agent, an inert solid, a fluid loss control agent, an emulsifier, a dispersion aid, a corrosion inhibitor, an emulsion thinner, an emulsion thickener, a viscosifying agent, a gelling agent, a particulate, a lost circulation material, a foaming agent, a gas, a pH control additive, a breaker, a biocide, a crosslinker, a chelating agent, a scale inhibitor, a gas hydrate inhibitor, a mutual solvent, an oxidizer, a reducer, a friction reducer, an iron control agent, the like, or any combination thereof. Suitable examples of the foregoing will be familiar to one having ordinary skill in the art.

Any of the fluids discussed herein may be mixed at a remote location from a job site and shipped thereto or may mixed at a job site. In still other examples, mixing of the fluid(s) may take place on-the-fly as the fluid is pumped into a subterranean reservoir. A person having ordinary skill in the art and the benefit of this disclosure will be able to consider these factors and determine whether remote mixing, on-site mixing, or any other suitable mixing protocol is most appropriate for a given operation.

Systems for introducing the fluids of the present disclosure into a subterranean reservoir may include one or more mixing and/or storage tanks for mixing and/or storing the fluids prior to their introduction to a subterranean reservoir. Additional tanks may be used for storing spent or partially spent fluids removed from a subterranean reservoir as part of a combined fracturing and cleanup operation. Following a fracturing operation, the fracturing fluids or a spent or partially spent variant thereof may be produced from the subterranean reservoir during fluid flowback, preferably following a cleanup operation conducted in accordance with the disclosure herein.

Systems for introducing the fluids to a wellbore in conjunction with a fracturing and/or a cleanup operation may comprise a pump fluidly coupled to a tubing extended into a wellbore penetrating the subterranean reservoir. The pump may comprise a single pump or may comprise multiple pumps, which may include high-pressure or low-pressure pumps in any combination. A high-pressure pump operating at a pressure greater than about 1000 psi, for example, may be used for fluid introduction at a pressure higher than the fracture gradient pressure of the subterranean reservoir. A low-pressure pump operating at a pressure of about 1000 psi or less, in contrast, may be used when lower introduction pressures are needed, such as for introducing the second fluid. Given the benefit of the present disclosure, one having ordinary skill in the art will be able to select an appropriate pump or combination of pumps for a given application.

The fluids of the present disclosure may be introduced into the subterranean reservoir using the pump(s) and tubing located within the wellbore. After fracturing and cleanup have occurred, the fluids and residual components (e.g., broken polymeric thickening agent) may be produced from the subterranean reservoir by flowing through the tubing or through an annulus defined in a space between the tubing and the walls of the wellbore.

Additional non-limiting components may be present in systems suitable to introduce and produce fluids according to the present disclosure and will be familiar to persons having ordinary skill in the art. Such components may include, for example, supply hoppers, valves, condensers, adapters, joints, gauges, sensors, compressors, pressure controllers, pressure sensors, flow rate controllers, flow rate sensors, temperature sensors, the like, or any combination thereof.

Embodiments disclosed herein include:

A. Methods for breaking a fluid in a subterranean reservoir. The methods comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; and contacting the first fluid with the second fluid in the subterranean reservoir during a cleanup period under conditions at which the first salt and the second salt undergo the exothermic reaction to generate heat; wherein the heat generated from the exothermic reaction at least partially breaks the polymeric thickening agent and decreases the first viscosity to a second viscosity.

B. Methods for breaking a fluid in a subterranean reservoir. The methods comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein the subterranean reservoir has a temperature sufficient to initiate the exothermic reaction between the first salt and the second salt; and contacting the first fluid with the second fluid in the subterranean reservoir during a cleanup period in which the first salt and the second salt undergo the exothermic reaction to generate heat; wherein the heat generated from the exothermic reaction at least partially breaks the polymeric thickening agent and decreases the first viscosity to a second viscosity.

C. Methods for breaking a fluid in a subterranean reservoir. The methods comprise: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein at least one of the first fluid or the second fluid contains an acid that initiates the exothermic reaction between the first salt and the second salt; and contacting the first fluid with the second fluid in the subterranean reservoir during a cleanup period in which the first salt and the second salt undergo the exothermic reaction to generate heat; wherein the heat generated from the exothermic reaction at least partially breaks the polymeric thickening agent and decreases the first viscosity to a second viscosity.

D. Methods for breaking a fluid in a subterranean reservoir. The methods comprise: providing a first fluid having a first viscosity, the first fluid comprising a polymeric thickening agent, a first salt, and a second salt, the first salt and the second salt being capable of undergoing an exothermic reaction with each other; introducing the first fluid into a subterranean reservoir at a pressure sufficient to create or extend one or more fractures therein; wherein the subterranean reservoir has a temperature insufficient to initiate the exothermic reaction between the first salt and the second salt; introducing an acid into the subterranean reservoir to initiate the exothermic reaction; and contacting the first fluid and the acid during a cleanup period in which the first salt and the second salt undergo the exothermic reaction to generate heat; wherein the heat generated from the exothermic reaction at least partially breaks the polymeric thickening agent and decreases the first viscosity to a second viscosity.

Each of embodiments A through D may have one or more of the following additional elements in any combination:

Element 1: wherein the first salt comprises a nitrite anion and the second salt comprises an ammonium cation, the nitrite anion and the ammonium cation undergoing the exothermic reaction.

Element 2: wherein the first salt comprises an alkali metal nitrite and the second salt comprises an ammonium halide.

Element 3: wherein the first salt comprises sodium nitrite and the second salt comprises ammonium chloride.

Element 4: wherein the first salt comprises an ammonium cation and the second salt comprises a nitrite anion, the nitrite anion and the ammonium cation undergoing the exothermic reaction.

Element 5: wherein the first salt comprises an ammonium halide and the second salt comprises an alkali metal nitrite.

Element 6: wherein the first salt comprises ammonium chloride and the second salt comprises sodium nitrite.

Element 7: wherein the subterranean reservoir comprises a clay.

Element 8: wherein the subterranean reservoir comprises a shale formation.

Element 9: wherein the second viscosity is lower than the first viscosity by about 99% or more.

Element 10: wherein the method further comprises releasing the pressure before introducing the second fluid.

Element 11: wherein the first fluid further comprises a plurality of particulates and at least a portion of the particulates are introduced to the plurality of fractures prior to introducing the second fluid.

Element 12: wherein the cleanup period ranges from about 1 hour to about 48 hours.

Element 13: wherein the subterranean reservoir has a temperature sufficient to initiate the exothermic reaction, an acid is introduced to the subterranean reservoir to initiate the exothermic reaction, or any combination thereof.

Element 14: wherein the exothermic reaction occurs at a temperature of about 60° C. or greater, at a pH of about 5 or less, or any combination thereof.

By way of non-limiting example, exemplary combinations applicable to A include, but are not limited to: 1 and 2; 2 and 3; 1 and 2 and 3; 4 and 5; 1 and 4 and 5; 1 and 6; 4 and 5 and 6; 1 and 7; 1 and 8; 1 and 9; 1 and 10; 1 and 11; 1 and 12; 1 and 13; 13 and 14; 1 and 13 and 14.

Exemplary combinations applicable to B, C, and D include, but are not limited to: 1 and 2; 2 and 3; 1 and 2 and 3; 4 and 5; 1 and 4 and 5; 1 and 6; 4 and 5 and 6; 1 and 7; 1 and 8; 1 and 9; 1 and 10; 1 and 11; 1 and 12.

Additional embodiments disclosed herein include:

Clause 1. A method comprising: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; and contacting the first fluid with the second fluid in the subterranean reservoir during a cleanup period under conditions at which the first salt and the second salt undergo the exothermic reaction to generate heat; wherein the heat generated from the exothermic reaction at least partially breaks the polymeric thickening agent and decreases the first viscosity to a second viscosity.

Clause 2. The method of Clause 1, wherein the first salt comprises a nitrite anion and the second salt comprises an ammonium cation, the nitrite anion and the ammonium cation undergoing the exothermic reaction.

Clause 3. The method of Clause 1 or Clause 2, wherein the first salt comprises an alkali metal nitrite and the second salt comprises an ammonium halide.

Clause 4. The method of any one of Clauses 1-3, wherein the first salt comprises sodium nitrite and the second salt comprises ammonium chloride.

Clause 5. The method of Clause 1, wherein the first salt comprises an ammonium cation and the second salt comprises a nitrite anion, the nitrite anion and the ammonium cation undergoing the exothermic reaction.

Clause 6. The method of Clause 1 or Clause 5, wherein the first salt comprises an ammonium halide and the second salt comprises an alkali metal nitrite.

Clause 7. The method of any one of Clauses 1, 5, or 6, wherein the first salt comprises ammonium chloride and the second salt comprises sodium nitrite.

Clause 8. The method of any one of Clauses 1-7, wherein the subterranean reservoir comprises a clay.

Clause 9. The method of any one of Clauses 1-8, wherein the subterranean reservoir comprises a shale formation.

Clause 10. The method of any one of Clauses 1-9, wherein the second viscosity is lower than the first viscosity by about 99% or more.

Clause 11. The method of any one of Clauses 1-10, further comprising: releasing the pressure before introducing the second fluid.

Clause 12. The method of any one of Clauses 1-11, wherein the first fluid further comprises a plurality of particulates and at least a portion of the particulates are introduced to the plurality of fractures prior to introducing the second fluid.

Clause 13. The method of any one of Clauses 1-12, wherein the cleanup period ranges from about 1 hour to about 48 hours.

Clause 14. The method of any one of Clauses 1-13, wherein the subterranean reservoir has a temperature sufficient to initiate the exothermic reaction, an acid is introduced to the subterranean reservoir to initiate the exothermic reaction, or any combination thereof.

Clause 15. The method of Clause 14, wherein the exothermic reaction occurs at a temperature of about 60° C. or greater, at a pH of about 5 or less, or any combination thereof.

Clause 16. A method comprising: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein the subterranean reservoir has a temperature sufficient to initiate the exothermic reaction between the first salt and the second salt; and contacting the first fluid with the second fluid in the subterranean reservoir during a cleanup period in which the first salt and the second salt undergo the exothermic reaction to generate heat; wherein the heat generated from the exothermic reaction at least partially breaks the polymeric thickening agent and decreases the first viscosity to a second viscosity.

Clause 17. A method comprising: providing a first fluid having a first viscosity, the first fluid comprising a polymeric thickening agent and a first salt capable of undergoing an exothermic reaction with a second salt; introducing the first fluid into a subterranean reservoir at a pressure sufficient to create or extend one or more fractures therein; introducing a second fluid comprising the second salt into the subterranean reservoir; wherein at least one of the first fluid or the second fluid contains an acid that initiates the exothermic reaction between the first salt and the second salt; and contacting the first fluid with the second fluid in the subterranean reservoir during a cleanup period in which the first salt and the second salt undergo the exothermic reaction to generate heat; wherein the heat generated from the exothermic reaction at least partially breaks the polymeric thickening agent and decreases the first viscosity to a second viscosity.

Clause 18. A method comprising: providing a first fluid having a first viscosity, the first fluid comprising a polymeric thickening agent, a first salt, and a second salt, the first salt and the second salt being capable of undergoing an exothermic reaction with each other; introducing the first fluid into a subterranean reservoir at a pressure sufficient to create or extend one or more fractures therein; wherein the subterranean reservoir has a temperature insufficient to initiate the exothermic reaction between the first salt and the second salt; introducing an acid into the subterranean reservoir to initiate the exothermic reaction; and contacting the first fluid and the acid during a cleanup period in which the first salt and the second salt undergo the exothermic reaction to generate heat; wherein the heat generated from the exothermic reaction at least partially breaks the polymeric thickening agent and decreases the first viscosity to a second viscosity.

EXAMPLES

A fracturing fluid containing sodium nitrite was formulated as specified in Table 1 below. Individual components were added and diluted with water to make 500 mL of fracturing fluid in total. The initial pH of the added water was 8.5, and after formulation the fracturing fluid initially had a pH of 7.82 during polymer hydration. Before crosslinking, the pH was 10.07, and after crosslinking with a borate crosslinker, the pH of the resulting crosslinked gel was 11.47.

TABLE 1

| Component | Amount Added | Final Concentration |
|---|---|---|
| $NaNO_2$ | 250 mL × 5M solution | 2.5M (0.17 g/mL = 170,000 ppm) |
| Polymeric Thickening Agent | 1.65 g | 55 ppt |
| Clay Stabilizer | 0.5 mL | 2.0 gpt |
| High-Temperature Gel Stabilizer | 1.25 mL | 5.0 gpt |
| Surfactant | 0.5 mL | 2.0 gpt |
| High-Temperature Stabilizer | 0.75 mL | 3.0 gpt |
| pH Buffer | 0.65 mL | 2.6 gpt |
| Borate Crosslinker | 0.75 mL | 3.0 gpt |

The viscosity of the fracturing fluid was measured at room temperature using a Fan 35 Viscometer at various times after crosslinking. The viscosity was 55 cP, 65 cP, and 67 cP at 10, 20, and 30 minutes after crosslinking was complete. The vortex closure time was 18 seconds, and the lip time was 12 seconds.

Figure 2:
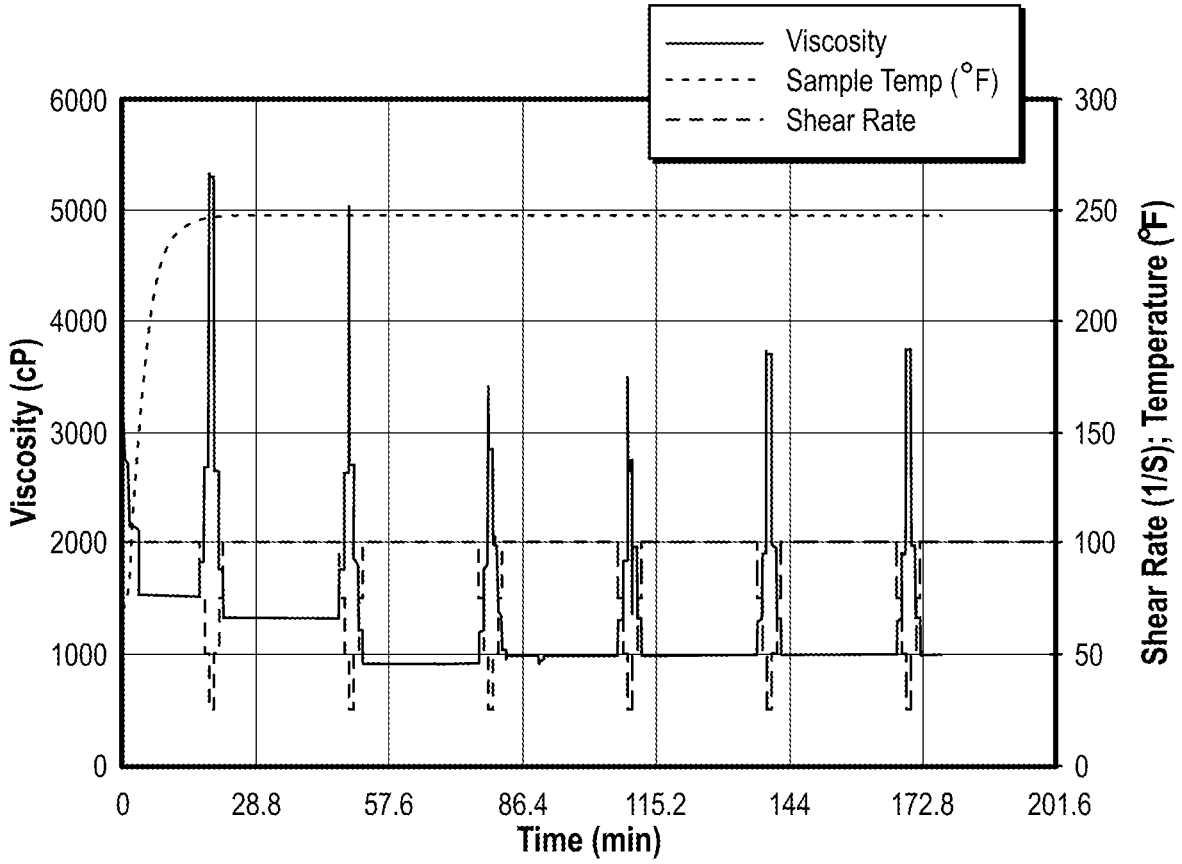
FIG. 2 is a graph of viscosity, temperature, and shear rate for an example according to the present disclosure.

100 mL of the above fracturing fluid was combined with 100 mL of 5 M aqueous $NH_4Cl$ solution in a standard filter press and subsequently aged at 250° F. for 24 hours. The temperature increased to greater than 350° C. after adding the $NH_4Cl$ solution was added. After aging, the viscosity dropped from an initial value of about 1000 cP value to a final value of about 8 cP. FIG. 2 is a graph showing viscosity, shear rate, and sample temperature for the combined sample as a function of aging time.

Figure 3:
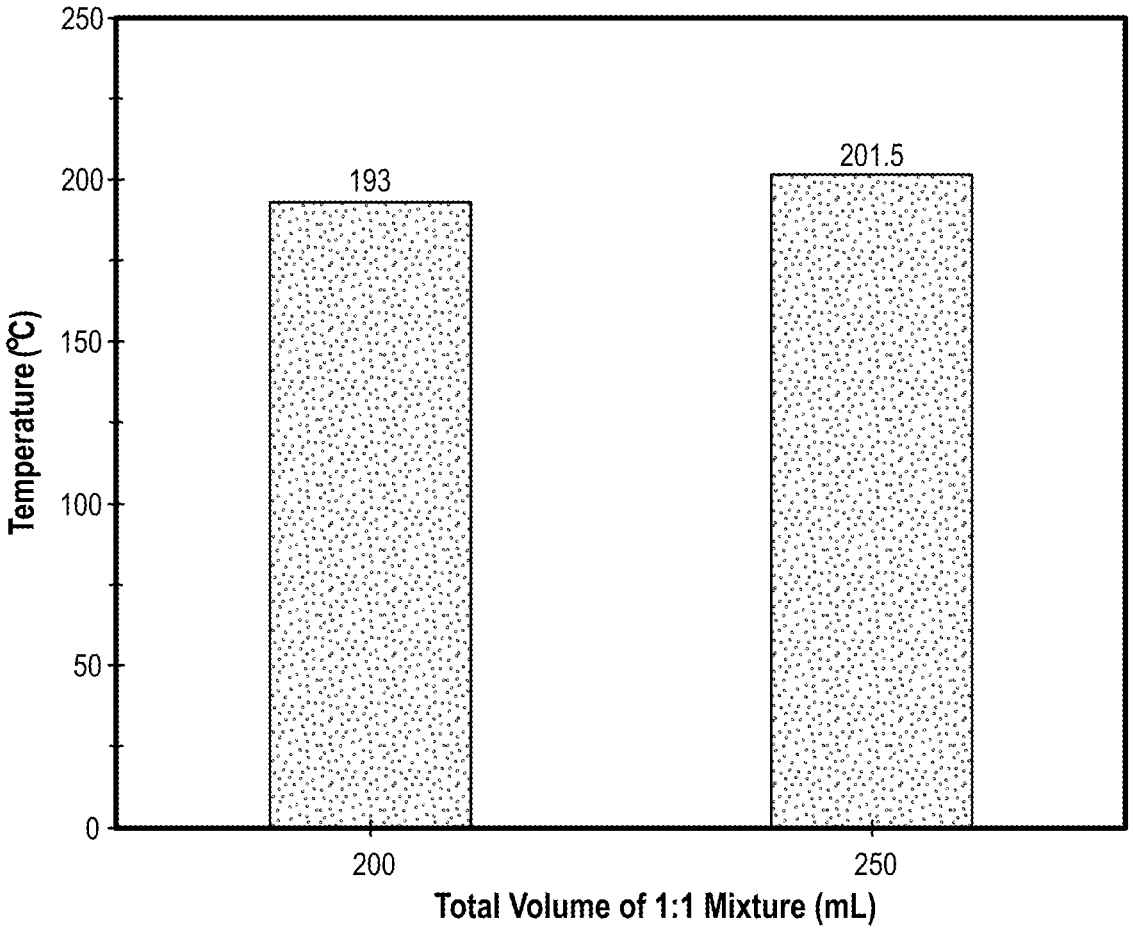
FIG. 3 is a bar graph demonstrating the amount of heat released from two different combined volumes of 5 M $NH_4Cl$ and 5 M $NaNO_2$ after heat activation at 90° C.

When the fracturing fluid and the cleanup fluid were introduced into a representative wellbore, the downhole temperature increased rapidly from 170° F. to 500° F. The amount of heat released and the temperature increase may vary with the amount of $NH_4Cl$ and $NaNO_2$ solution that are combined together. FIG. 3 is a bar graph demonstrating the amount of heat released from two different combined volumes of 5 M $NH_4Cl$ and 5 M $NaNO_2$ after heat activation at 90° C. As shown, a larger volume of combined fluids yielded a larger temperature increase.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and are not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A method comprising:

providing a first fluid having a first viscosity, the first fluid comprising a polymeric thickening agent and a first salt capable of undergoing an exothermic reaction with a second salt;

introducing the first fluid into a subterranean reservoir during a fracturing period at a pressure sufficient to create or extend one or more fractures therein;

releasing the pressure after the fracturing period;

introducing a second fluid comprising the second salt into the subterranean reservoir during a cleanup period;

wherein the first fluid and the second fluid each excludes an acid that initiates the exothermic reaction between the first salt and the second salt;

wherein the first fluid contacts the second fluid in the subterranean reservoir during the cleanup period under conditions at which the first salt and the second salt undergo the exothermic reaction to generate heat; and wherein the heat generated from the exothermic reaction breaks the polymeric thickening agent and decreases the first viscosity to a second viscosity.

2. The method of claim 1, wherein the first salt comprises a nitrite anion and the second salt comprises an ammonium cation, the nitrite anion and the ammonium cation undergoing the exothermic reaction.

3. The method of claim 2, wherein the first salt comprises an alkali metal nitrite and the second salt comprises an ammonium halide.

4. The method of claim 2, wherein the first salt comprises sodium nitrite and the second salt comprises ammonium chloride.

5. The method of claim 1, wherein the first salt comprises an ammonium cation and the second salt comprises a nitrite anion, the nitrite anion and the ammonium cation undergoing the exothermic reaction.

6. The method of claim 5, wherein the first salt comprises an ammonium halide and the second salt comprises an alkali metal nitrite.

7. The method of claim 5, wherein the first salt comprises ammonium chloride and the second salt comprises sodium nitrite.

8. The method of claim 1, wherein the subterranean reservoir comprises a clay.

9. The method of claim 1, wherein the subterranean reservoir comprises a shale formation.

10. The method of claim 1, wherein the second viscosity is lower than the first viscosity by about 50% to about 99.9%.

11. The method of claim 1, wherein the first fluid further comprises a plurality of particulates and at least a portion of the plurality of particulates are introduced to the one or more fractures prior to introducing the second fluid.

12. The method of claim 1, wherein the cleanup period ranges from about 1 hour to about 48 hours.

13. The method of claim 1, wherein the subterranean reservoir has a temperature sufficient to initiate the exothermic reaction, an acid is introduced to the subterranean reservoir to initiate the exothermic reaction, or any combination thereof.

14. The method of claim 13, wherein the exothermic reaction occurs at a temperature of about 50° C. to about 95° C., at a pH of about 5 or less, or any combination thereof.

15. The method of claim 1, wherein the first fluid further comprises a stabilizer, wherein the stabilizer comprises a gel stabilizer, a clay stabilizer, a thiosulfate stabilizer, an alkaline earth metal oxide, or any combination thereof.

16. The method of claim 1, wherein the polymeric thickening agent comprises polysaccharide, poly((C2-C10)alkenylene), poly(acrylic acid) or (C1-C5)alkyl ester thereof, poly(methacrylic acid) or (C1-C5)alkyl ester thereof, poly (vinyl acetate), poly(ethylene glycol), poly(vinyl pyrrolidone), polyacrylamide, poly(hydroxyethyl methacrylate), alginate, curdlan, dextran, emulsan, gellan, glucuronan, N-acetyl-glucosamine, N-acetyl-heparosan, hyaluronic acid, kefiran, lentinan, levan, mauran, pullulan, scleroglucan, schizophyllan, stewartan, succinoglycan, welan, derivatized starch, tamarind, tragacanth, gum ghatti, gum arabic, locust bean gum, or any combination thereof.

17. The method of claim 1, wherein the first fluid has an acidic pH and the second fluid has an alkaline pH, or vice versa.

18. The method of claim 1, wherein the first salt comprises an ammonium cation and the second salt comprises a nitrite anion, or vice versa, and wherein the molar ratio of the salt comprising the ammonium cation to the salt comprising the nitrite anion is about 2:1.

19. A method comprising:

providing a first fluid having a first viscosity, the first fluid comprising a polymeric thickening agent and a first salt capable of undergoing an exothermic reaction with a second salt;

introducing the first fluid into a subterranean reservoir during a fracturing period at a pressure sufficient to create or extend one or more fractures therein;

releasing the pressure after the fracturing period;

introducing a second fluid comprising the second salt into the subterranean reservoir during a cleanup period;

wherein the subterranean reservoir has a temperature sufficient to initiate the exothermic reaction between the first salt and the second salt;

wherein the first fluid contacts the second fluid in the subterranean reservoir during the cleanup period in which the first salt and the second salt undergo the exothermic reaction to generate heat; and wherein the heat generated from the exothermic reaction breaks the polymeric thickening agent and decreases the first viscosity to a second viscosity.

20. A method comprising:

providing a first fluid having a first viscosity, the first fluid comprising a polymeric thickening agent and a first salt capable of undergoing an exothermic reaction with a second salt;

introducing the first fluid into a subterranean reservoir during a fracturing period at a pressure sufficient to create or extend one or more fractures therein;

releasing the pressure;

introducing a second fluid comprising the second salt into the subterranean reservoir during a cleanup period;

wherein at least one of the first fluid or the second fluid contains an acid that initiates the exothermic reaction between the first salt and the second salt;

wherein the first fluid contacts the second fluid in the subterranean reservoir during the cleanup period in which the first salt and the second salt undergo the exothermic reaction to generate heat; and wherein the heat generated from the exothermic reaction breaks the polymeric thickening agent and decreases the first viscosity to a second viscosity.

* * * * *